US011198030B2

(12) United States Patent
Endelman

(10) Patent No.: US 11,198,030 B2
(45) Date of Patent: Dec. 14, 2021

(54) PED-A-PULL EXERCISE APPARATUS

(71) Applicant: Balanced Body, Inc., Sacramento, CA (US)

(72) Inventor: Ken Endelman, Sacramento, CA (US)

(73) Assignee: BALANCED BODY, INC., Sacramento, CA (US)

( * ) Notice: Subject to any disclaimer, the term of this patent is extended or adjusted under 35 U.S.C. 154(b) by 150 days.

(21) Appl. No.: 16/750,929

(22) Filed: Jan. 23, 2020

(65) Prior Publication Data

US 2020/0246651 A1 Aug. 6, 2020

Related U.S. Application Data

(60) Provisional application No. 62/801,941, filed on Feb. 6, 2019.

(51) Int. Cl.
*A63B 21/00* (2006.01)
*A63B 21/04* (2006.01)
(Continued)

(52) U.S. Cl.
CPC .... *A63B 21/00185* (2013.01); *A63B 21/0442* (2013.01); *A63B 21/0557* (2013.01); *A63B 21/4034* (2015.10); *A63B 23/03541* (2013.01)

(58) Field of Classification Search
CPC ..... A63B 21/00185; A63B 21/0442; A63B 23/03541; A63B 21/4034; A63B 21/0557;
(Continued)

(56) References Cited

U.S. PATENT DOCUMENTS 2,919,134 A * 12/1959 Zurojohn ..... A63B 21/04 482/129
3,606,321 A * 9/1971 Macoulis ..... A63B 21/04 482/122
(Continued)

FOREIGN PATENT DOCUMENTS

CN 103751949 A 4/2014
JP 2005-168907 A 6/2005

OTHER PUBLICATIONS

International Search Report and Written Opinion, dated May 27, 2020, from corresponding International Patent App. No. PCT/US2020/014815.
(Continued)

*Primary Examiner* — Andrew S Lo
(74) *Attorney, Agent, or Firm* — Greenberg Traurig, LLP

(57) ABSTRACT

An exercise apparatus includes a base configured to rest on a horizontal floor surface. A vertical pole member is fastened to the base and extends vertically from the floor surface. A cross bar sleeve is fastened to an upper end portion of the vertical pole member and supports a pair of cross bar members extending in opposite directions. One or more elastic resistance members extends from the cross bar members. A rectangular foot support plate is removably supported on the base. This rectangular foot support plate has a pair of spaced apart lugs projecting from an underside surface of the foot support plate along one edge. Each is adapted to fit within one of a plurality of recesses in the base so as to incline the foot support plate at an angle with respect to the base when the foot support plate is supported on the base.

17 Claims, 9 Drawing Sheets

(51) Int. Cl.
*A63B 23/035* (2006.01)
*A63B 21/055* (2006.01)

(58) Field of Classification Search
CPC . A63B 21/16; A63B 2225/093; A63B 71/023; A63B 2071/027
See application file for complete search history.

(56) References Cited

U.S. PATENT DOCUMENTS 3,724,450 A * 4/1973 Chaitin ..... A61H 1/02 601/31
4,720,100 A * 1/1988 Du Buy ..... A63B 21/0455 482/112
5,318,495 A * 6/1994 Malynowsky ..... A63B 21/023 482/129
5,399,139 A * 3/1995 Malynowsky ..... A63B 21/023 248/188.7
6,270,448 B1 * 8/2001 Smith ..... A63B 17/04 482/148
6,290,630 B1 9/2001 Boland
8,597,165 B1 12/2013 Antonucci
9,072,933 B1 * 7/2015 Huster ..... A63B 21/0428
10,449,104 B2 * 10/2019 Jamesapollos ..... A61H 1/0218
2003/0224880 A1 * 12/2003 Hansberry ..... A63B 69/0002 473/430
2007/0238588 A1 * 10/2007 Butler ..... A63B 21/015 482/70
2014/0315662 A1 * 10/2014 Buono ..... A63B 69/0079 473/418
2016/0129329 A1 * 5/2016 Fadde ..... A63B 69/0002 473/417
2017/0014666 A1 * 1/2017 Sather ..... A63B 23/03541
2018/0015325 A1 1/2018 Wang

OTHER PUBLICATIONS

Contrology Ped-O-Puls by Balanced Body, Inc., downloaded from the internet at https://Contrology.pilates.com/ped-o-pul on Jun. 3, 2020.

* cited by examiner

PED-A-PULL EXERCISE APPARATUS

CROSS-REFERENCE TO RELATED APPLICATIONS

This application claims benefit of priority of U.S. Patent Application No. 62/801,941, filed Feb. 6, 2019, entitled "PED-A-PULL EXERCISE APPARATUS", which is incorporated herein by reference in its entirety.

BACKGROUND OF THE DISCLOSURE

The present disclosure is directed to exercise equipment and more particularly to an improved Ped-A-Pull exercise apparatus.

A Ped-A-Pull is an exercise apparatus first developed by Joseph H. Pilates in the last century. A Ped-A-Pull is essentially a vertical pole mounted on a flat disk shaped platform that rests on a floor and is typically spaced from a vertical wall. The pole may include one or more strap supports along its length that are used to fasten the pole to the wall such that the pole is parallel to and spaced from the vertical wall. A cross bar is fastened to the upper end of the pole and a pair of elastic members such as coil springs each have one end fastened to an end of the cross bar. The other end of each elastic member is attached to a hand grip. A person using the Ped-A-Pull stands on the platform, facing toward or away from the pole, grasps the hand grips, and performs various exercises with the elastic members while maintaining a proper posture on the platform.

SUMMARY OF THE DISCLOSURE

An exercise apparatus in accordance with the present disclosure includes One exemplary exercise apparatus in accordance with the present disclosure includes a base configured to rest on a horizontal floor surface, a vertical pole member fastened to the base and extending vertically from the floor surface, a cross bar sleeve fastened to an upper end portion of the vertical pole member, the cross bar sleeve supporting a pair of cross bar members extending in opposite directions from the cross bar sleeve, and one or more elastic resistance members extending from a distal end of each of the cross bar members.

The apparatus has a foot support plate removably supported on the base, wherein the foot support plate forms a vertical angle from the base. Preferably the foot support plate has a first edge and a second edge and two spaced apart lugs adjacent the first edge, each lug engaging a feature on the base to elevate the first edge of the foot support plate at the vertical angle. The base preferably has a plurality of spaced apart recesses in its upper surface each for receiving one of the lugs projecting from the foot support plate.

The foot support plate may be removably supported on the base. The foot support plate may have a pair of spaced apart lugs projecting from an underside surface of the foot support plate along one edge each adapted to fit within one of the plurality of recesses so as to incline the foot support plate at an angle with respect to the base when the foot support plate is supported on the base. Furthermore, the foot support preferably has a central recess in each of the front and rear edges sized to fit around the vertical pole member. The base may have four spaced recesses each for receiving one of the lugs such that the foot support plate may be reversed on the base to present the foot support plate at a different vertical angle with respect to the base.

The exercise apparatus may also include the cross bar sleeve having a feature engageable with one of a series of holes in the vertical pole to change position of the cross bar sleeve on the upper end portion of the vertical pole. This feature is a retractable pin projecting from the sleeve into the one hole in the vertical pole.

The exercise apparatus in accordance with the present disclosure preferably includes a rectangular foot support plate removably supported on the base, wherein the rectangular foot support plate has a pair of spaced apart lugs projecting from an underside surface of the foot support plate along one edge each adapted to fit within one of the plurality of recesses so as to incline the foot support plate at an angle with respect to the base when the foot support plate is supported on the base. This foot support plate has a front edge and a rear edge and has a central recess in each of the front and rear edges sized to fit around the vertical pole member. The base has four spaced recesses each for receiving one of the lugs, and the foot support plate may be reversed on the base to present the foot support plate at a different vertical angle with respect to the base.

An embodiment in accordance with the present disclosure may be viewed as an exercise apparatus including a base configured to rest on a horizontal floor surface. The base has a plurality of spaced recesses therein, a vertical pole member fastened to the base and extending vertically from the floor surface, a cross bar sleeve fastened to an upper end portion of the vertical pole member, the cross bar sleeve supporting a pair of cross bar members extending in opposite directions from the cross bar sleeve, one or more elastic resistance members extending from a distal end of each of the cross bar members, and a foot support plate removably supported on the base, wherein the foot support plate forms a vertical angle from the base. This foot support plate has a first edge and a second edge and two spaced apart lugs adjacent the first edge, each lug engaging one of the recesses on the base to elevate the first edge of the foot support plate at the vertical angle. The foot support plate may be reversed on the base to present the foot support plate at a different vertical angle with respect to the base.

An embodiment of an exercise apparatus in accordance with the present disclosure may alternatively be viewed as including a base configured to rest on a horizontal floor surface. The base has a plurality of spaced recesses therein. A vertical pole member is fastened to the base and extends vertically from the floor surface. A cross bar sleeve is fastened to an upper end portion of the vertical pole member. This cross bar sleeve supports a pair of cross bar members extending in opposite directions from the cross bar sleeve. One or more elastic resistance members preferably extends from a distal end of each of the cross bar members so as to be grasped by a user standing adjacent the vertical pole member when performing exercises. The user stands on a rectangular foot support plate removably supported on the base. This rectangular foot support plate has a pair of spaced apart lugs projecting from an underside surface of the foot support plate along one edge each adapted to fit within one of the plurality of recesses in the base so as to incline the foot support plate at an angle with respect to the base when the foot support plate is supported on the base.

DETAILED DESCRIPTION

Figure 1:
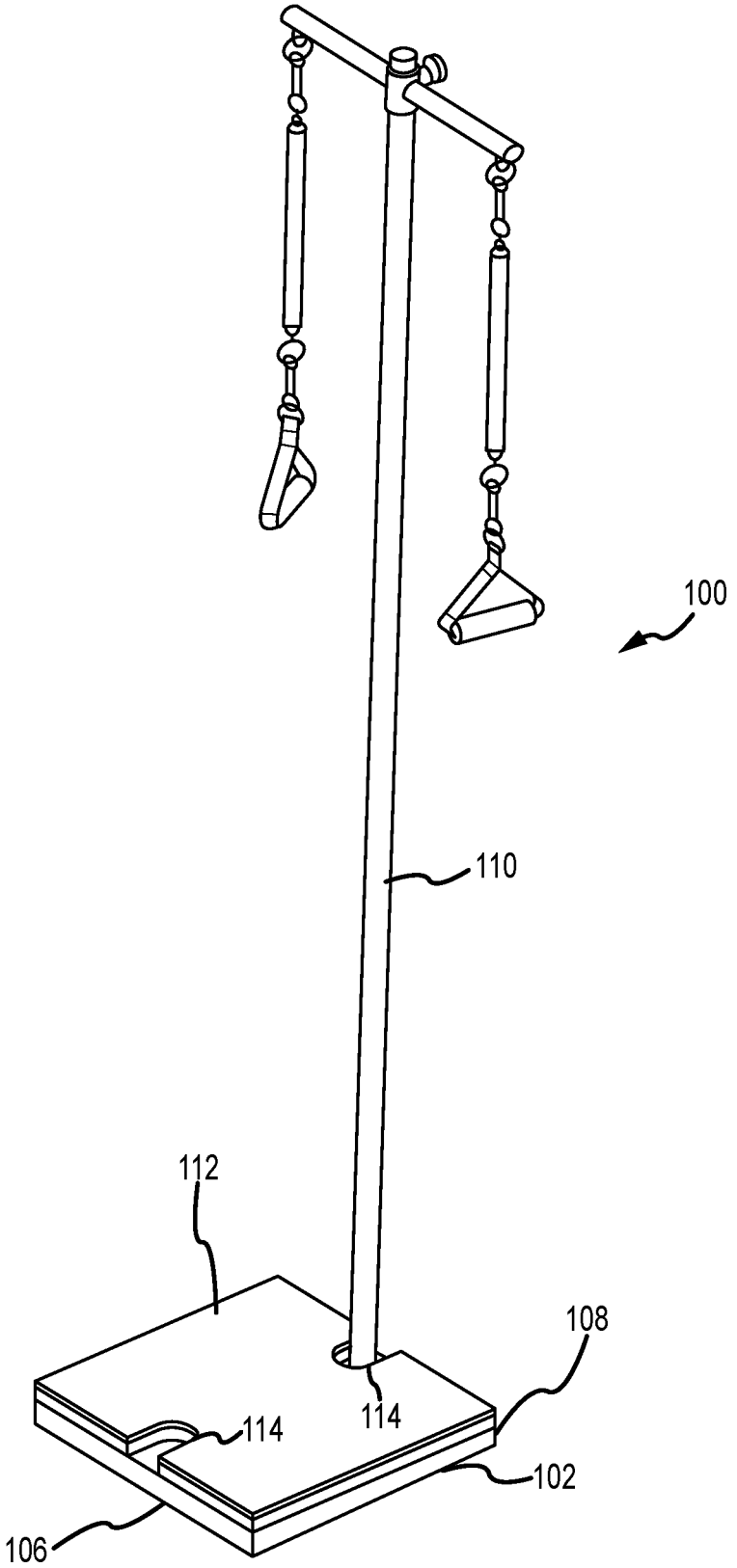
FIG. 1 is a front perspective view of an exercise apparatus in accordance with the present disclosure.
Figure 2:
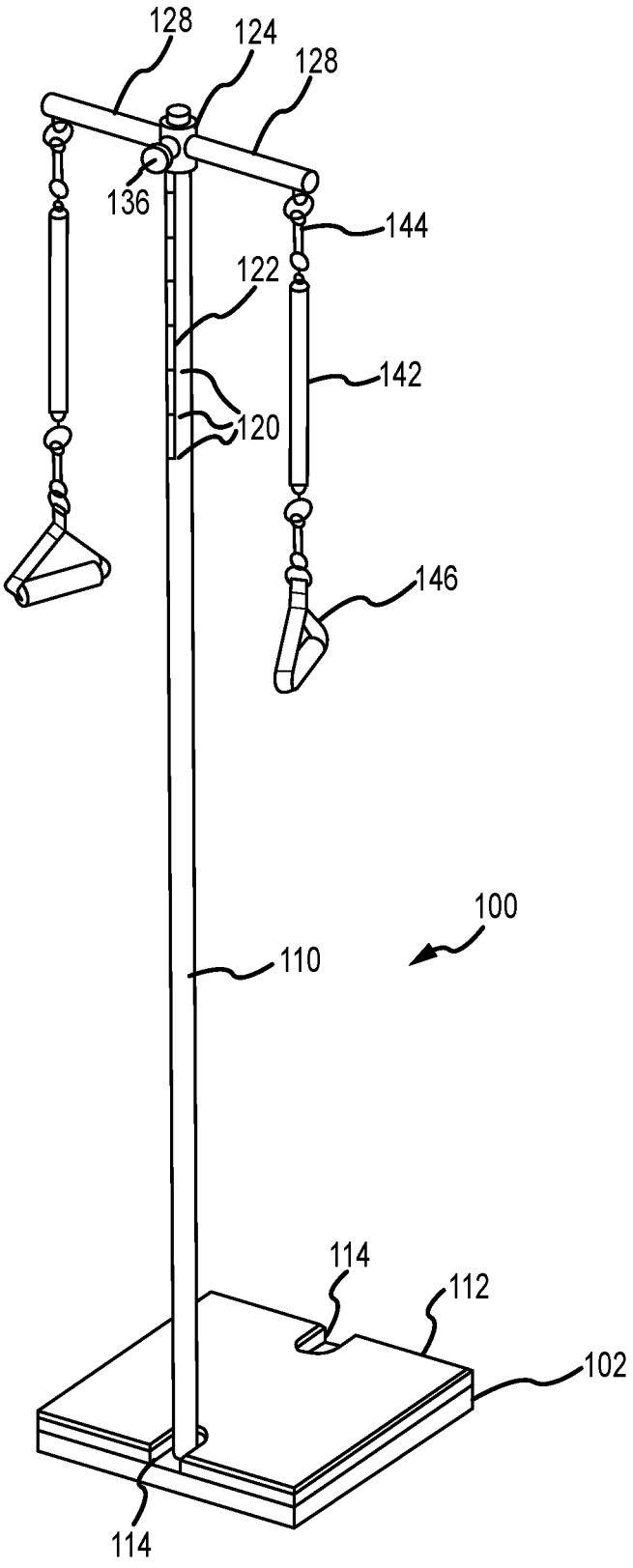
FIG. 2 is a rear perspective view of the exercise apparatus shown in FIG. 1.
Figure 3:
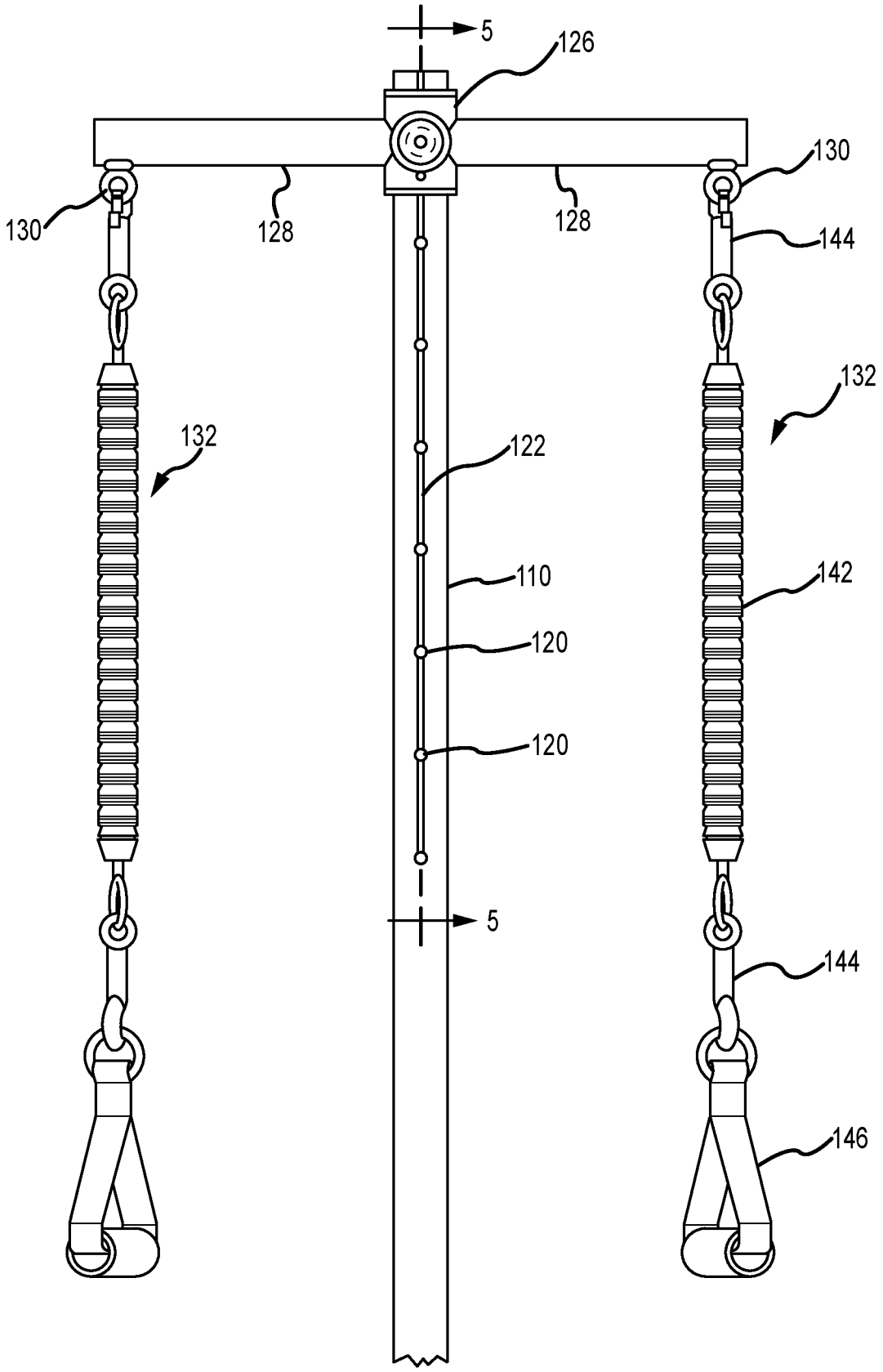
FIG. 3 is a rear elevation view of the upper portion of the exercise apparatus shown in FIG. 1.
Figure 6:
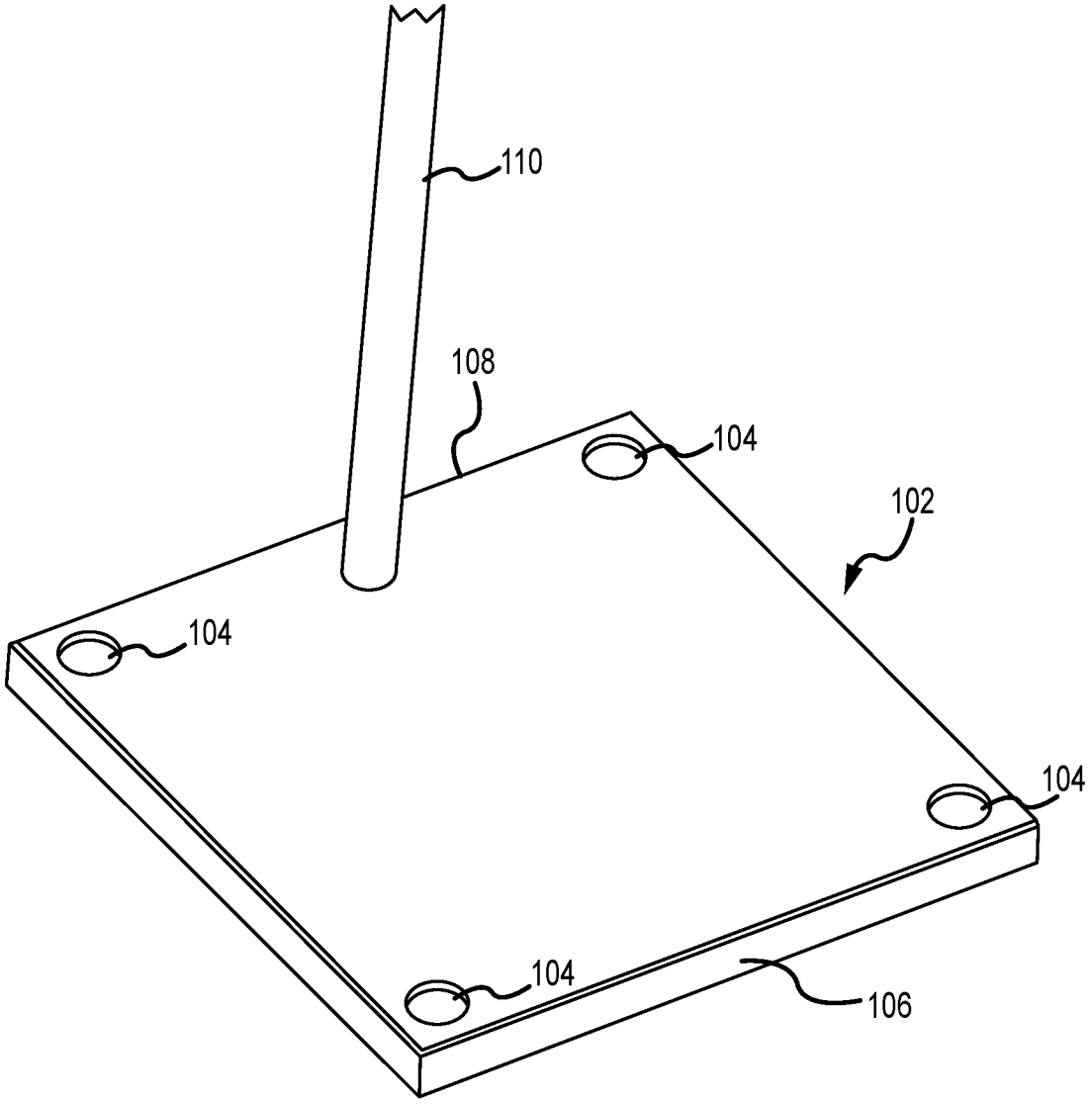
FIG. 6 is a perspective view of the base of the exercise apparatus shown in FIG. 1 with the foot platform removed.

FIG. 1 is a front perspective view of the Ped-A-Pull exercise apparatus 100 in accordance with the present disclosure. Apparatus 100 includes a flat base 102 for resting on a horizontal surface such as a floor. This base may be circular, rectangular as shown, or may have any other flat configuration such as oval. The base 102 has four recesses 104 (shown in FIG. 6) with two spaced apart, each adjacent a corner, along a front edge 106 of the base 102 and two recesses 104 spaced apart along a rear edge 108 of the base 102 on either side of a vertical pole 110 having its bottom end fastened to the base 102.

Figure 7:
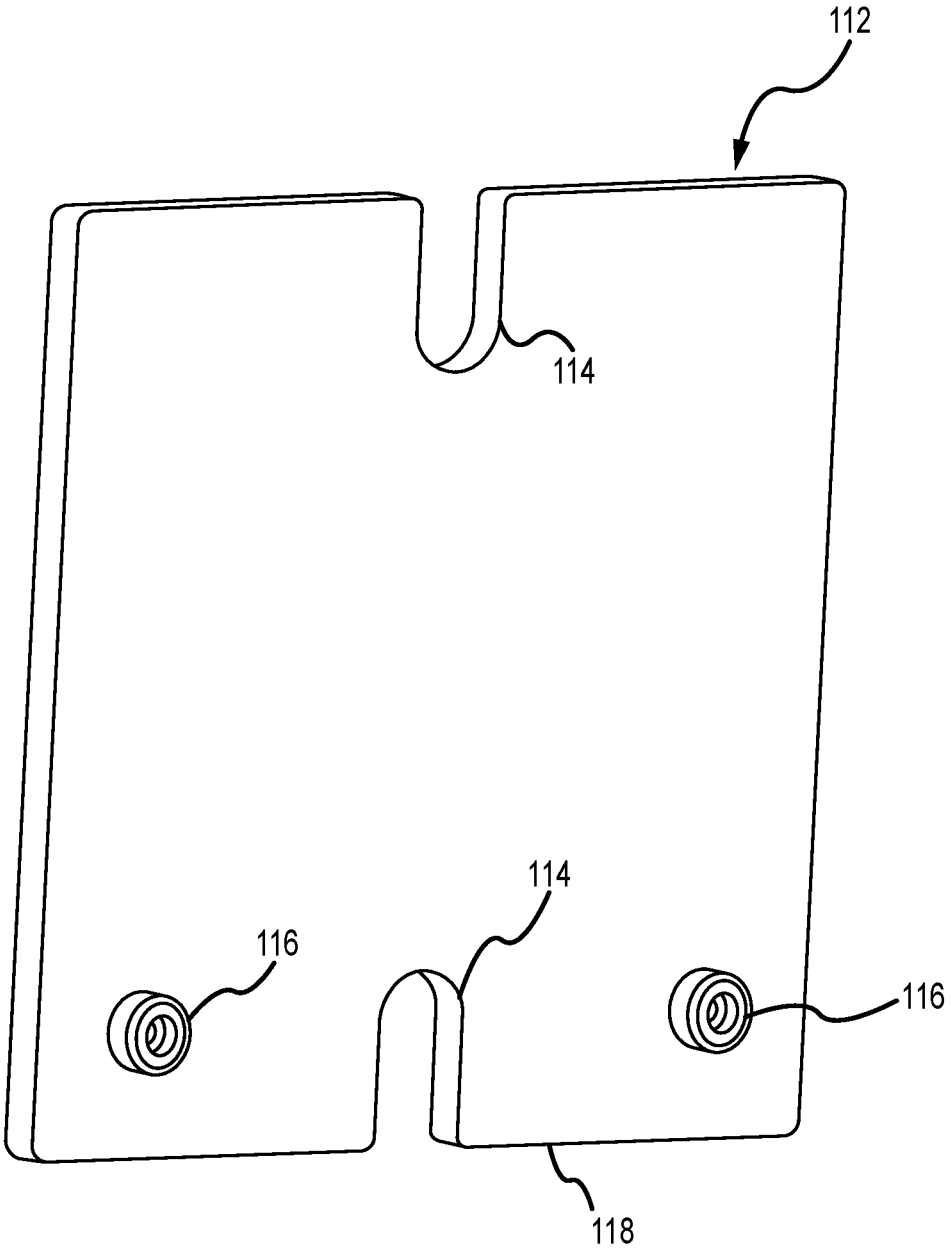
FIG. 7 is a separate underside perspective view of the foot platform.
Figure 8:
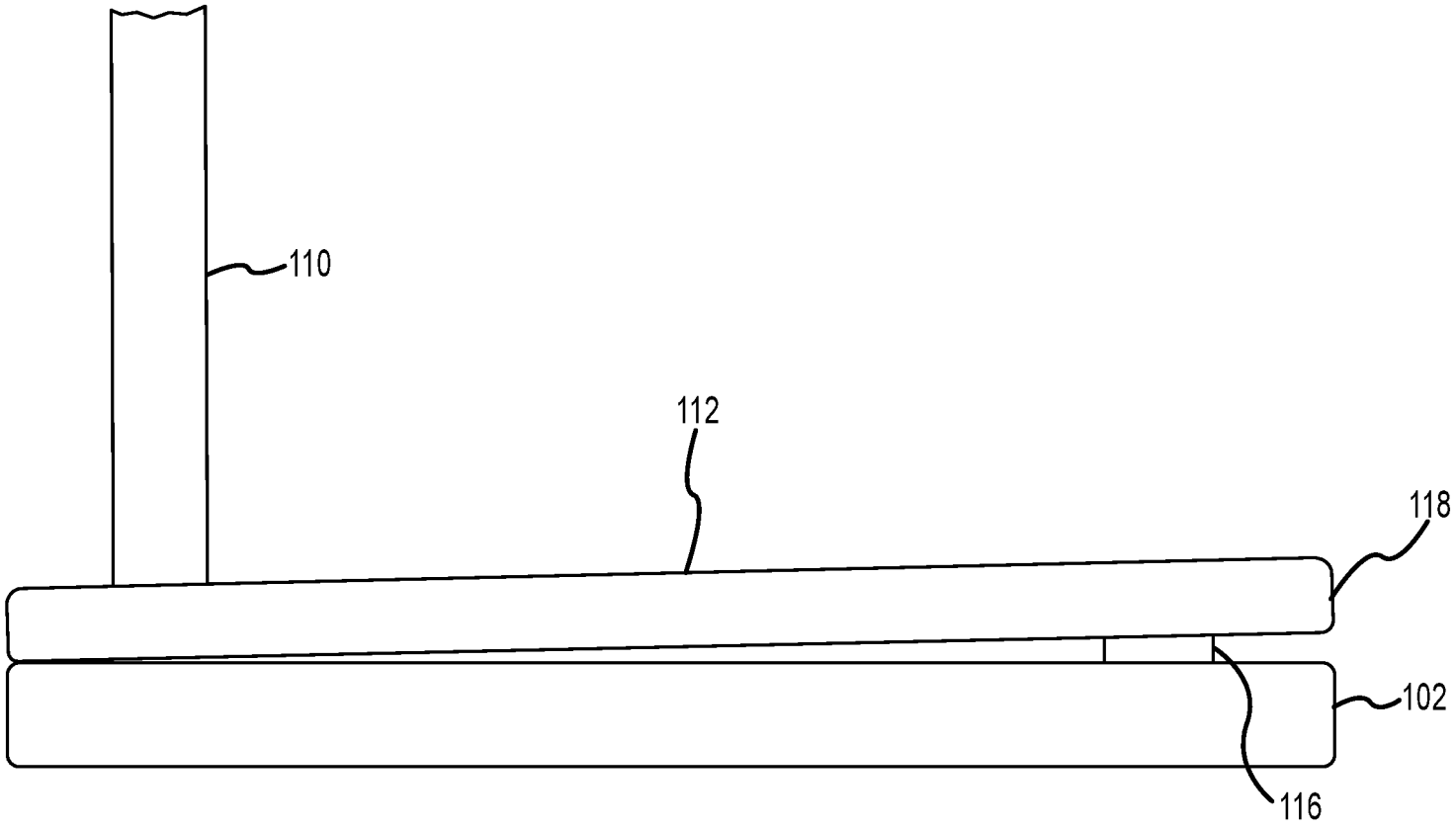
FIG. 8 is a side view of the lower portion of the exercise apparatus shown in FIG. 1.

A removable foot platform 112 is positioned on top of the base 102. This foot platform preferably has an outer shape similar to that of the base 102 except that it has a pair of recesses 114 centrally located in the front and rear edges of the platform 112. A separate underside view of the foot platform 112 is shown in FIG. 7. This platform is rectangular with two lugs 116 along one edge 118 of the platform 112, positioned complementary to two of the recesses 104 in the base 102 such that when the foot platform 112 is placed on the base 102, the two lugs 116 fit into two of the recesses 104 in the base 102. When the foot platform 112 is so positioned on the base 102, the edge 118 is elevated above the base 102 as is shown in FIG. 8.

Figure 9:
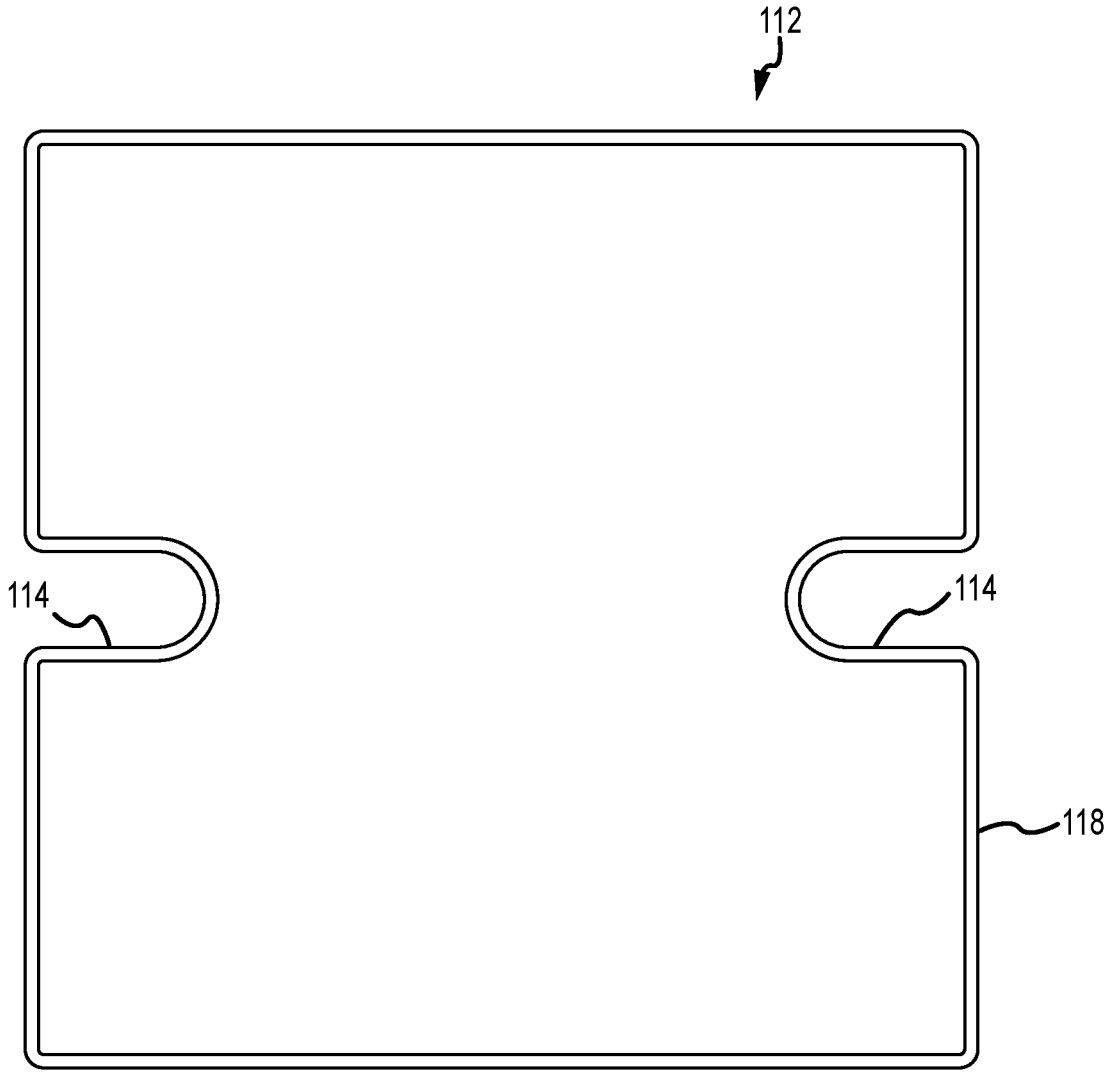
FIG. 9 is a separate top view of the foot platform shown in FIG. 7.

As is shown in FIG. 9, the foot platform 112 has two recesses 114. These recesses 114 permit the foot platform 112 to be reversed on the base 102 such that the two lugs 116 fit into the recesses 104 along the rear edged of the base 102, with one of the recesses 114 accommodating passage of the pole 110. In this reversed position, the foot platform 112 will be raised at the rear of the apparatus 100, giving a user standing on the platform 112 a different stance or tilt for his or her feet during exercise.

Figure 4:
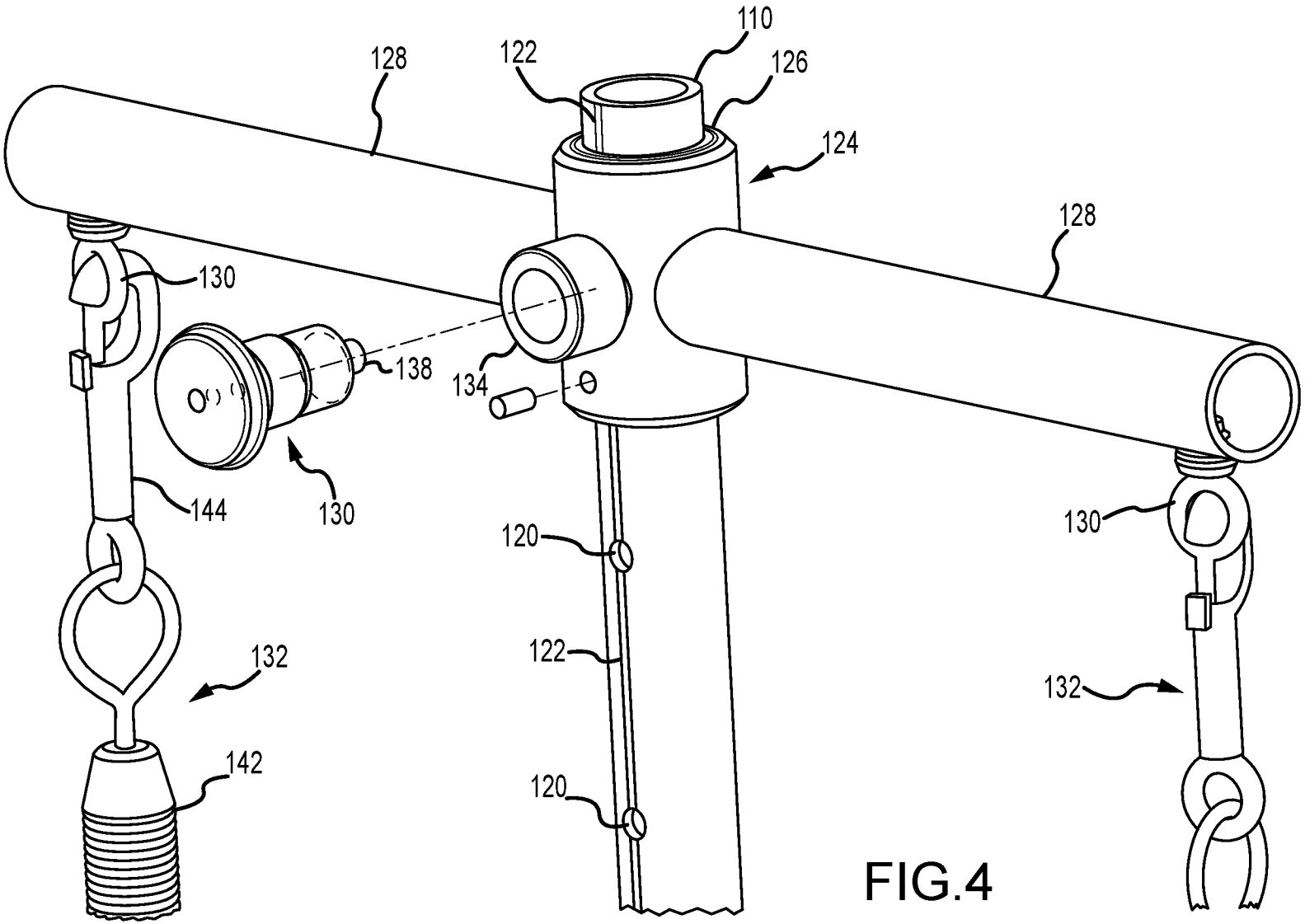
FIG. 4 is a partial exploded perspective view of the upper portion of the exercise apparatus shown in FIG. 3.
Figure 5:
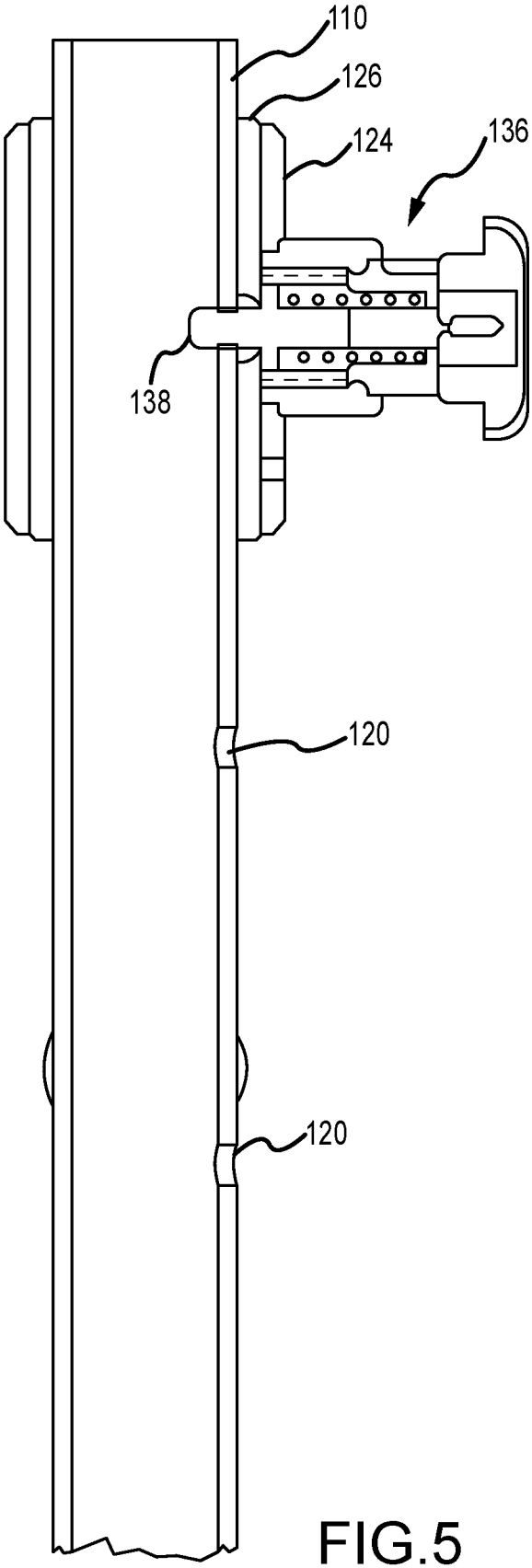
FIG. 5 is a sectional view of the upper portion of the exercise apparatus taken along the line 5-5 in FIG. 3.

The vertical pole 110 is preferably a metal tube fixed into the base 102. The upper portion of the pole 110 has a plurality of vertically spaced holes 120 along preferably the back side of the pole 110, best seen in FIG. 4. A vertical groove 122 connects these holes 120. Slidably mounted to the upper end of the vertical pole 110 is a cross bar sleeve 124. This cross bar sleeve 124 includes a plastic liner 126 to facilitate smooth position adjustment of the sleeve along the pole 110. Fixed to opposite sides of the cross bar sleeve 124 are two cross bar members 128 that extend at a right angle from the pole 110. An eye bolt 130 is fastened to the distal end of each cross bar member 128, for attachment to an elastic resistance member 132.

The cross bar sleeve 124 has a boss 134 into which a spring loaded handle plug 136 is fastened. This spring loaded plug 136 has a tip 138 that engages one of the holes 120 to position the cross bar sleeve 124 at various positions along the pole 110 so as to accommodate users of different heights. The cross bar sleeve 124 also carries a guide pin 140 that rides in the slot 122 in order to keep the cross bar members 128 properly aligned parallel to the rear edge of the base 102 at all times. This guide pin 140 may simply be a set screw that loosely projects into the groove 122.

Preferably the series of holes 120 and groove 122 are formed in the rear face of the pole 110 such that when the apparatus is placed against a wall they will be hidden from view. Likewise, the spring loaded plug 136 would face the wall. Different types of elastic members 132 may be attached to the eye of the eye bolts 130 at the distal ends of the cross bar members 128. One example is a conventional coil spring 142 that is attached via a conventional spring clip 144. The opposite end of the coil spring 142 is preferably attached to a hand grip 146.

Different spring sets may also be used. Different sets of replaceable lugs 116 may be used to provide different tilt angles in the exercise apparatus 100 described herein. All such changes, alternatives and equivalents in accordance with the features and benefits described herein, are within the scope of the present disclosure. Any or all of such changes and alternatives may be introduced without departing from the spirit and broad scope of this disclosure.

The invention claimed is:

1. An exercise apparatus comprising:

a base configured to rest on a horizontal floor surface and a foot support plate removably supported on the base, wherein the base has a plurality of spaced apart recesses in its upper surface;

a vertical pole member fastened to the base and extending vertically from the floor surface;

a cross bar sleeve fastened to an upper end portion of the vertical pole member, the cross bar sleeve supporting a pair of cross bar members extending in opposite directions from the cross bar sleeve; and one or more elastic resistance members extending from a distal end of each of the cross bar members.

2. The exercise apparatus according to claim 1 wherein the foot support plate has a pair of spaced apart lugs projecting from an underside surface of the foot support plate along one edge each adapted to fit within one of the plurality of recesses so as to incline the foot support plate at an angle with respect to the base when the foot support plate is supported on the base.

3. The exercise apparatus according to claim 2 wherein the base has four spaced recesses each for receiving one of the lugs.

4. The exercise apparatus according to claim 2 wherein the foot support plate may be reversed on the base to present the foot support plate at a different vertical angle with respect to the base.

5. The exercise apparatus according to claim 2 further comprising the cross bar sleeve having a feature engageable with one of a series of holes in the vertical pole to change position of the cross bar sleeve on the upper end portion of the vertical pole.

6. The exercise apparatus according to claim 5 wherein the foot support plate has a first edge and a second edge and two spaced apart lugs adjacent the first edge, each lug engaging the base to elevate the first edge of the foot support plate at a vertical angle.

7. The exercise apparatus according to claim 6 wherein the feature is a retractable pin projecting from the sleeve into the one hole in the vertical pole.

8. The exercise apparatus according to claim 7 wherein each lug engages one of the plurality of spaced apart recesses in the upper surface of the base.

9. The exercise apparatus according to claim 1 wherein the foot support plate is a rectangular foot support plate and has a pair of spaced apart lugs projecting from an underside surface of the foot support plate along one edge each adapted to fit within one of the plurality of recesses so as to incline the foot support plate at an angle with respect to the base when the foot support plate is supported on the base.

10. The exercise apparatus according to claim 9 wherein the foot support plate a front edge and a rear edge and has a central recess in each of the front and rear edges sized to fit around the vertical pole member.

11. The exercise apparatus according to claim 10 wherein the base has four spaced recesses each for receiving one of the lugs.

12. The exercise apparatus according to claim 9 wherein the foot support plate may be reversed on the base to present the foot support plate at a different vertical angle with respect to the base.

13. An exercise apparatus comprising:

a base configured to rest on a horizontal floor surface and a foot support plate removably supported on the base, the foot support plate forming an angle from the base, wherein the foot support plate has a first edge and a second edge and two spaced apart lugs adjacent the first edge, each lug engaging a feature on the base to elevate the first edge of the foot support plate at the angle;

a vertical pole member fastened to the base and extending vertically from the floor surface;

a cross bar sleeve fastened to an upper end portion of the vertical pole member, the cross bar sleeve supporting a pair of cross bar members extending in opposite directions from the cross bar sleeve; and one or more elastic resistance members extending from a distal end of each of the cross bar members.

14. An exercise apparatus comprising:

a base configured to rest on a horizontal floor surface, the base having a plurality of spaced recesses therein;

a vertical pole member fastened to the base and extending vertically from the floor surface;

a cross bar sleeve fastened to an upper end portion of the vertical pole member, the cross bar sleeve supporting a pair of cross bar members extending in opposite directions from the cross bar sleeve;

one or more elastic resistance members extending from a distal end of each of the cross bar members; and a foot support plate removably supported on the base, wherein the foot support plate forms a vertical angle from the base.

15. The exercise apparatus according to claim 14 wherein the foot support plate has a first edge and a second edge and two spaced apart lugs adjacent the first edge, each lug engaging one of the recesses on the base to elevate the first edge of the foot support plate at the vertical angle.

16. The exercise apparatus according to claim 14 wherein the foot support plate may be reversed on the base to present the foot support plate at a different vertical angle with respect to the base.

17. An exercise apparatus comprising:

a base configured to rest on a horizontal floor surface, the base having a plurality of spaced recesses therein;

a vertical pole member fastened to the base and extending vertically from the floor surface;

a cross bar sleeve fastened to an upper end portion of the vertical pole member, the cross bar sleeve supporting a pair of cross bar members extending in opposite directions from the cross bar sleeve;

one or more elastic resistance members extending from a distal end of each of the cross bar members; and a rectangular foot support plate removably supported on the base, wherein the rectangular foot support plate has a pair of spaced apart lugs projecting from an underside surface of the foot support plate along one edge each adapted to fit within one of the plurality of recesses in the base so as to incline the foot support plate at an angle with respect to the base when the foot support plate is supported on the base.

* * * * *